US005098306A

United States Patent [19]

Noschese et al.

[11] Patent Number: 5,098,306

[45] Date of Patent: Mar. 24, 1992

[54] CARD EDGE CONNECTOR WITH SWITCHING CONTACTS

[75] Inventors: Rocco J. Noschese, Wilton; Michael N. Perugini, Southington; Yuetchin Hoi, Shelton, all of Conn.

[73] Assignee: Burndy Corporation, Norwalk, Conn.

[21] Appl. No.: 658,115

[22] Filed: Feb. 20, 1991

[51] Int. Cl.[5] ..... H01R 29/00

[52] U.S. Cl. ..... 439/188; 439/92; 439/637

[58] Field of Search ..... 439/59, 60, 62, 92, 439/180, 188, 507, 509, 512, 513, 630, 636, 637

[56] References Cited

U.S. PATENT DOCUMENTS

| | | | |
|---|---|---|---|
| 2,983,896 | 5/1961 | Gilbert | 339/184 |
| 3,646,504 | 2/1972 | Classon | 439/188 |
| 4,087,151 | 5/1978 | Robert et al. | 439/637 |
| 4,106,841 | 8/1978 | Vladic | 439/637 |
| 4,285,565 | 8/1981 | Kirby | 339/176 MP |
| 4,514,030 | 4/1985 | Triner et al. | 439/188 |
| 4,759,729 | 7/1988 | Kemppainen et al. | 439/580 |
| 4,846,734 | 7/1989 | Lytle | 439/637 |
| 4,934,961 | 6/1990 | Piorunneck et al. | 439/637 |
| 4,996,766 | 3/1991 | Piorunneck et al. | 439/637 |
| 5,024,609 | 6/1991 | Piorunneck | 439/637 |
| 5,041,023 | 8/1991 | Lytle | 439/637 |

FOREIGN PATENT DOCUMENTS

| | | | |
|---|---|---|---|
| 2133938 | 8/1984 | United Kingdom | 439/188 |

OTHER PUBLICATIONS

Agard et al., "Coaxial Cable to Printed Circuit Board Connector", IBM Technical Disclosure Bulletin, vol. 13, No. 6, Nov. 1970, p. 1595.

*Primary Examiner*—Paula A. Bradley
*Attorney, Agent, or Firm*—Perman & Green

[57] ABSTRACT

A card edge connector having spring contacts that are partially movable by insertion of a circuit board into the connector. The contacts include two contacts that electrically contact each other when a circuit board is not connected to the connector. The two contacts are moved by insertion of a circuit board into the connector which results in disconnection of the electrical contact between the two contacts. This allows a signal contact to be contacted and grounded by a ground contact while the connector is not in use and, nonetheless allows independent ground and signal functions of the two contacts when a circuit board is connected to the connector.

16 Claims, 3 Drawing Sheets

FIG. 4
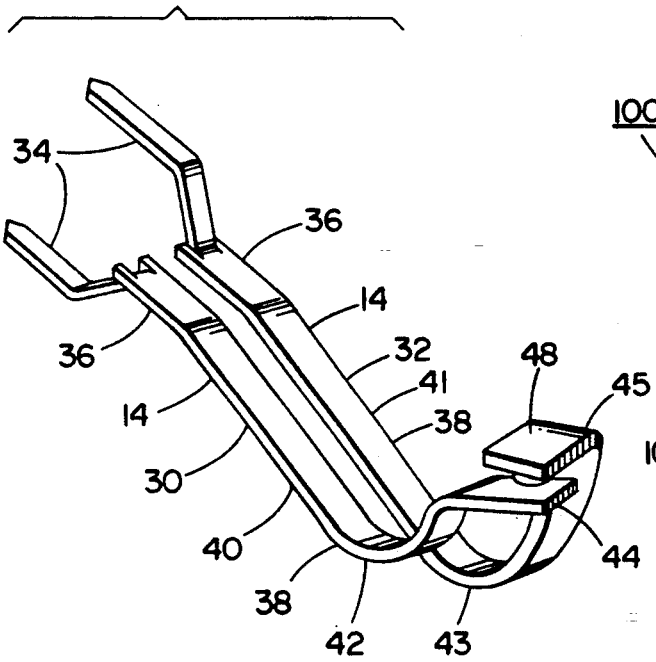
FIG. 5
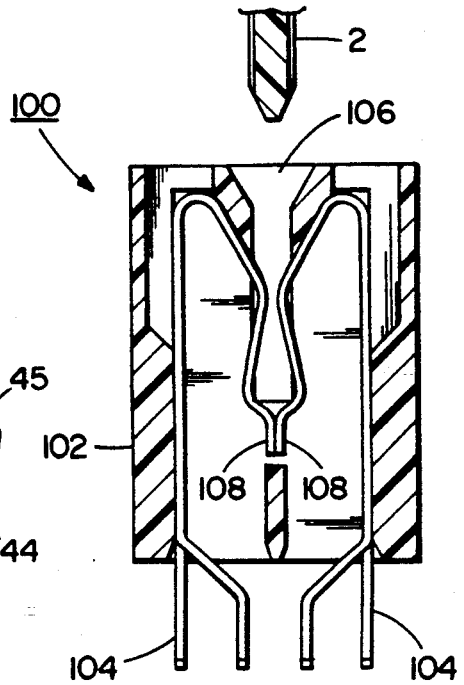
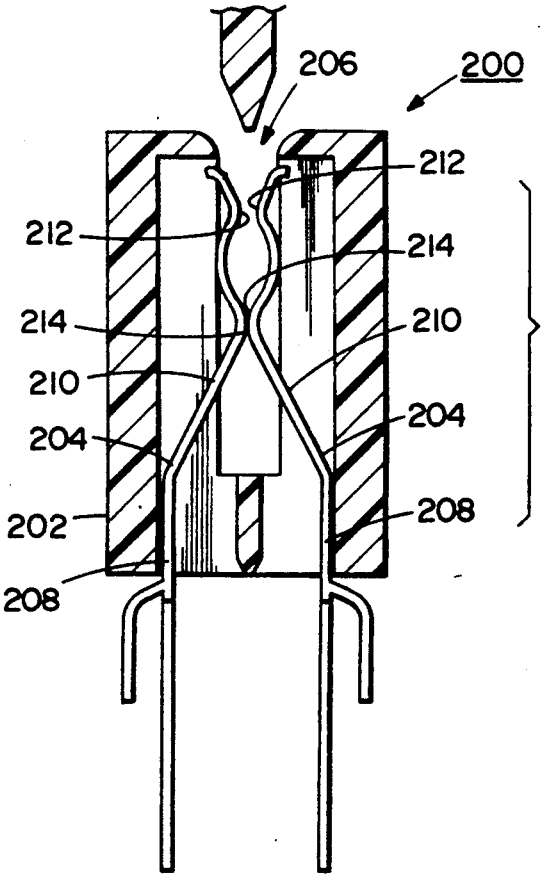
FIG. 6

CARD EDGE CONNECTOR WITH SWITCHING CONTACTS

BACKGROUND OF THE INVENTION

1. Field of the Invention

The present invention relates to electrical connectors and, more particularly, to an electrical connector having movable switching contacts and a method of converting grounded contacts into nongrounded contacts.

2. Prior Art

Card edge connectors are wide known and used for electrically and mechanically connecting a mother printed circuit board with a daughter printed circuit board. Lytle U.S. Pat. No. 4,846,734 discloses one type of card edge connector that has a card edge receiving slot and two rows of spring contacts. Piorunneck et al. U.S. Pat. No. 4,934,961 discloses a bi-level card edge connector with two different types of spring contacts intended to contact an edge of a daughter board at two different levels. Andrews, Jr. U.S. Pat. No. 4,869,671 discloses a bi-level card edge connector adapted to be used with two different types of daughter boards. A ground shielded bi-level card edge connector can also be found described in copending patent application Ser. No. 07/532,300 filed June 1, 1990, now U.S. Pat. No. 5,035,631, assigned to the same assignee as herein, which is hereby incorporated by reference in its entirety. Numerous other prior art exists regarding card edge connectors.

A problem exists with the prior art card edge connectors in that, for instances when a daughter printed circuit board is not connected to the connector, the signal contacts of the connector are susceptible to electromagnetic forces. These electromagnetic forces or impulses can be generated by surrounding circuits and current flow which can generate electrical current in the unused signal contacts of the connector. This, of course, can result in false signals being transmitted to a mother printed circuit board. Machines, such as computers, are usually supplied with multiple extra card edge connectors as expansion slots for extra daughter printed circuit boards for expanding the uses and functions of the machine. Thus, the above problem is widespread, especially in the computer industry. In addition, although in the past slower card edge connectors, such as 8-Bit and 16-Bit connectors, did not see extensive electromagnetic problems, the newer and faster card edge connectors, such as 32-Bit, 64-Bit and larger card edge connectors, have higher electrical spikes that generate greater electromagnetic impulses. Thus, the problem is becoming increasingly widespread with newer and faster computers.

It is therefore an objective of the present invention to provide a new and improved card edge connector and method that overcomes problems in the prior art and provides additional features.

SUMMARY OF THE INVENTION

The foregoing problems are overcome and other advantages are provided by a new and improved card edge connector having switching contacts and a method of converting grounded contacts into signal contacts upon insertion of a daughter printed circuit board into the connector.

In accordance with one embodiment of the present invention, a card edge connector is provided comprising a housing, a plurality of spring contacts, and means for selectively electrically connecting at least two of the spring contacts to each other. The housing is comprised of electrically insulating material and has a card edge receiving slot and at least one row of contact chambers partially opened to the slot. The plurality of spring contacts are at least partially movably positioned in the contact chambers. The means for selectively electrically connecting at least two of the contacts to each comprises the two contacts being movable into and out of contact with each other.

In accordance with another embodiment of the present invention, a card edge connector is provided comprising a housing and at least one pair of switching contacts. The housing is comprised of dielectric material and has a card edge receiving slot and a row of contact chambers communicating with the slot. The at least one pair of switching contacts is movably mounted in the contact chambers of the housing and has a first position wherein the contacts are electrically connected to each other and a second position wherein the contacts are spaced from each other.

In accordance with one method of the present invention, a method of connecting a daughter board to a card edge connector is provided. The method comprises steps of inserting an edge of the daughter board into a card edge receiving slot of the connector; and converting grounded signal contacts into non-grounded signal contacts upon insertion of the daughter board into the slot. The step of converting comprises the daughter board pushing on ground contacts and the grounded signal contacts as the daughter board is inserted into the slot to separate the ground contacts and signal contacts from each other.

In accordance with another embodiment of the present invention, a card edge connector is provided comprising a housing, a first type of contact, and a second type of contact, the housing is comprised of electrically insulating material and has a card edge receiving area and at least one row of contact chambers. The first type of contact is located in the contact chambers of the housing. The second type of contact is located in the contact chambers of the housing and electrically contacts the first type of contact in a first position. The second type of contact is movable, by insertion of a daughter board into the receiving area, to a second position wherein the first and second types of contacts do not electrically contact each other.

BRIEF DESCRIPTION OF THE DRAWINGS

The foregoing aspects and other features of the present invention are explained in the following description, taken in connection with the accompanying drawings, wherein:

FIG. 4 is a perspective view of a first type of spring contact and second type of spring contact used in the connector shown in FIG. 1.

FIG. 5 is a cross sectional view of an alternate embodiment of a connector incorporating features of the present invention.

FIG. 6 is a cross-sectional view of an alternate embodiment of a connector incorporating features of the present invention.

DETAILED DESCRIPTION OF THE INVENTION

Figure 1:
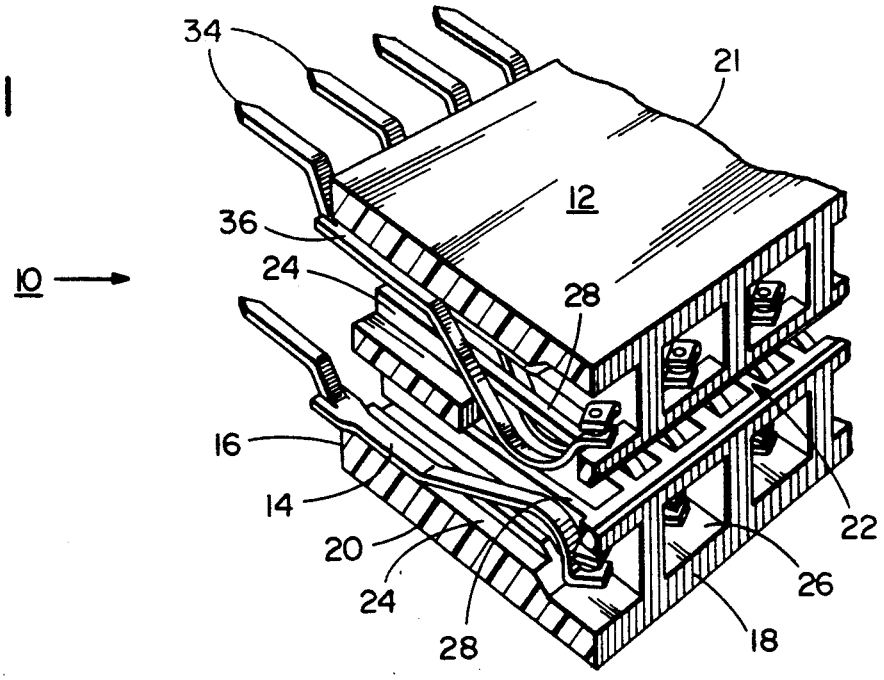
FIG. 1 is a perspective cut away partial view of a card edge connector incorporating features of the present invention.

Referring to FIG. 1, there is shown a cut away partial perspective view of a connector 10 incorporating features of the present invention. The connector 10, in the embodiment shown, is a card edge connector for use in electrically and mechanically connecting a daughter printed circuit board to a mother printed circuit board. Although the present invention will be described with reference to the embodiments shown in the drawings, it should be understood that the present invention can be embodied in various different alternative forms and in combination with various different features. In addition, any suitable size, shape or type of elements or materials could be used.

The connector 10 shown in FIG. 1 is generally comprised of a housing 12 and a plurality of spring contacts 14 connected to the housing 12. The housing 12 is generally comprised of a dielectric or electrically insulating material such as molded plastic. In the embodiment shown, the housing 12 has a general elongate shape with a bottom 16, top 18, and sidewalls 20 and 21. Extending down into the housing 12 from its top 18 is a card edge receiving area or slot 22. In the embodiment shown, located on opposite sides of the slot 22 are a plurality of contact chambers 24. The contact chambers 24 extend from the bottom 16 to the top 18 and, in the embodiment shown, pairs of contact chambers 24 share a common open top 26. The contact chambers 24 are partially open to the card edge receiving slot 22. Bars 28 help to define and keep separate the openings of the contact chambers 24 into the slot 22.

Figure 2:
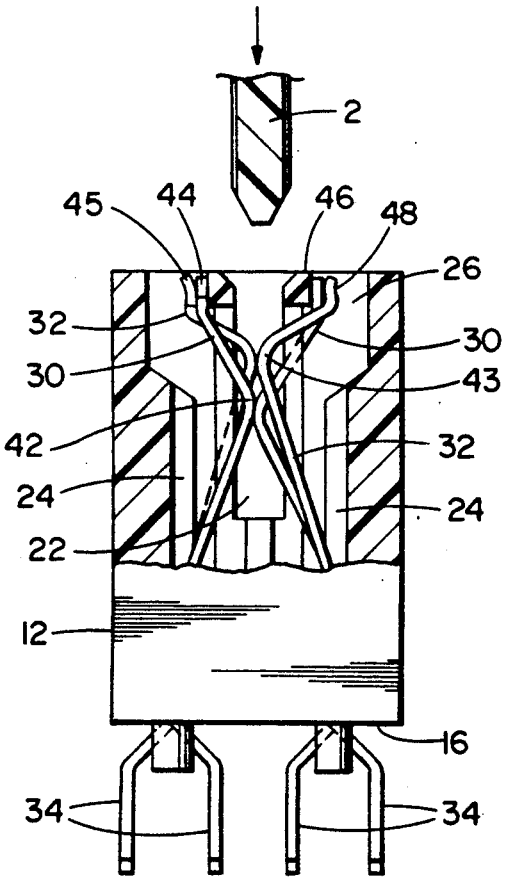
FIG. 2 is a partial cross sectional view of the connector shown in FIG. 1 with its spring contacts in a first position prior to insertion of a daughter printed circuit board.
Figure 3:
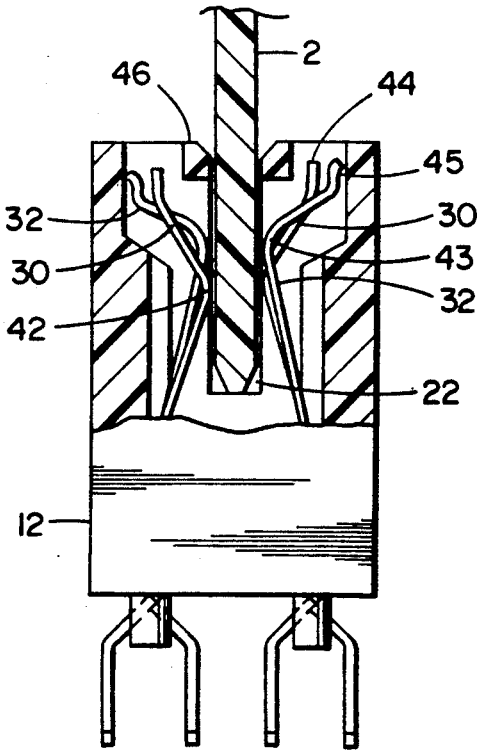
FIG. 3 is a partial cross sectional view of the connector shown in FIG. 1 with a daughter printed circuit board connected thereto and having its spring contacts in a second position.

Referring also to FIGS. 2, 3, and 4, the spring contacts 14 are comprised of electrically conductive material and are arranged in the contact chambers 24 of the housing in essentially two parallel rows generally symmetric about the central plane of the connector. In the embodiment shown, the spring contacts 14 are comprised of a first type of spring contact 30 and a second type of spring contact 32. The first and second types of spring contacts 30 and 32 both comprise a first portion 34 that extends from the bottom 16 of the housing 12 in the form of solder tails for connection to a mother printed circuit board (not shown). However, any suitable type of connection to a mother board could be provided. A second portion 36 is fixedly mounted in a bottom portion of the contact chambers 24. However, any suitable type of means to stationarily mount a portion of the contacts with the housing could be provided. The contacts also have a third portion 38 extending upward from the second portion 36 and intended to contact an inserted daughter printed circuit board 2.

The third portion 38 of the contacts 30 and 32, in the embodiment shown, are slightly different from each other. The first type of contact 30 has an angled section 40, a bend or bight 42 intended to contact a pad on the daughter board 2, and a top 44 intended to be positioned against housing prestress portion 46. The second type of contact 32 has an angled section 41 that is angled away from its second portion 36 at a slightly less angle than angled section 40, a bend or bight 43 intended to contact a pad on the daughter board 2, and a top 45 having a switching bridge 48 that extends laterally relative to the length of the second type of contact.

In the embodiment shown, the first and second types of contacts 30 and 32 are positioned in the housing 12 as a pair in adjacent contact chambers 24 that share a common open top 26. The contacts 30 and 32 basically have two positions. The first position is a home position wherein the daughter board 2 has not been inserted into the connector 10. This first position can be seen in FIG. 2. In this home position, due to a preloading or prestressing of the contact third portions 38, the bights 42 and 43 of the contacts extend into the card edge receiving slot 22. The top 44 of the first type of contact 30 is preloaded against housing prestress portion 46. The top 45 of the second type of contact 32, due to its lateral bridge 48 is preloaded against the back of the first type of contact 30. Thus, in the home position, the pair of contacts 30 and 32 make electrical and mechanical contact with each other via the bridge 48 in the common open top 26 of the housing. It should be understood that any suitable type of switching bridge can be provided between the contacts. In a preferred embodiment, one of the contacts of the pair of contacts 30 and 32 is connected to be connected to a ground in the mother printed circuit board (not shown) and the other contact of the pair of contacts is intended to be a signal contact to transmit signals between the mother board and the daughter board 2 when the daughter board is inserted into the connector 10. Thus, in the home position, the signal contact is grounded via the ground contact such that false signals cannot be electromagnetically generated and transmitted to the mother board. Although only a pair of contacts are described above, it should be understood that three or more contacts may be similarly connected to one another for a switching connection. In addition, in the embodiment shown, the bridge 48 has a dimple to insure proper contact stress against the first type of contact.

The second position that the contacts 30 and 32 can have is shown in FIG. 3. The second position is obtained by insertion of the daughter board 2 into the slot 22. As the edge of the daughter board 2 is inserted into the slot 22, it wedges the contacts 30 and 32 on both sides of the slot 22 backwards via contact with the bights 42 and 43. As the bights 42 and 43 are pushed backwards, the tops 44 and 45 are also moved backwards, but different distances from their initial home positions. This disproportionate movement of the tops 44 and 45 is accomplished by the different shapes of the contacts 30 and 32. The different movements results in the bridging connection between the contacts 30 and 32 at their tops 44 and 45 being disengaged. Thus, the signal contact is electrically separated from the grounding contact and can function as a signal contact between the mother and daughter boards. The grounding contact retains its grounding features and can function as a grounding contact between the two boards.

The different movements of the tops 44 and 45 from their first position to their second position is accomplished due to the different shapes of the third portions 38. As noted above, the second portions 36 are stationarily connected to the housing 12. As the second type of contacts 32 are pushed backward by the daughter board 2, the tops 45 moves back a first predetermined distance. As the first type of contacts 30 are pushed backward by the daughter board 2, the tops 44 move back a second predetermined distance shorter than the first predetermined distance. These different lengths of movements of tops 44 and 45 is accomplished, even thought bights 42 and 43 are moved backward the same length, because of the different angles that the angled sections 40 and 41 extend up from the second portions 36 and, the different angles that the tops 44 and 45 extend up from the bights 42 and 43. Because of these different angles, part of the horizontal movement at the bights 42 and 43 are translated into different vertical movements and different horizontal movements at tops 44 and 45. However, any suitable means for disconnecting the electrical connection between the pairs of contacts 30 and 32 could be provided. In the event the daughter board 2 is removed from the connector 10, the contacts 30 and 32 would return to their home position as shown in FIG. 2.

Referring now to FIG. 5, an alternate embodiment of the invention is shown. In the embodiment shown, the connector 100 has a housing 102 with two rows of contacts 104 on opposite sides of edge receiving slot 106. In the embodiment shown, opposing contacts in each row span a gap below the slot 106 to touch each other via bridge portions 108. In a preferred embodiment, the pair of opposing contacts would include one signal contact and one ground contact. As the daughter board 2 is inserted into the slot 106, the opposing contacts 104 are pushed apart such that bridge portions 108 are separated to thus switch the grounded signal contact into an ungrounded signal contact. However, any suitable type of switching or briding connection between opposing contacts could be provided.

Referring now to FIG. 6, an alternate embodiment of the invention is shown. In the embodiment shown, the connector 200 has a housing 202 with two rows of contacts 204 on opposite sides of edge receiving slot 206. In the embodiment shown, each contact 204 has a middle section 208 fixed to the housing 202 and a top section 210 with an upper contact surface 212 and a lower contact surface 214. The opposing contacts 204 in each row have portions of their top sections 210 located in the slot 206 in a home position. In the embodiment shown, the lower contact surfaces 214 of the opposing contacts 204 contact each other in the home position to form an electrical bridge between the opposing contacts. In a preferred embodiment, the pair of opposing contacts would include one signal contact and one ground contact. As the daughter board 2 is inserted into the slot 206, the opposing contacts 204 are pushed apart such that the lower contact surfaces 214 are separated from each other. This effectively switches the grounded signal contact into an ungrounded signal contact. If the board 2 is removed, the two opposing contacts move back towards each other and contact each other again to converted the signal contact back into a grounded signal contact. The lower contact surfaces 214 thus are adapted to function both as bridges and as contact surfaces for the daughter board 2.

Figure 7B:
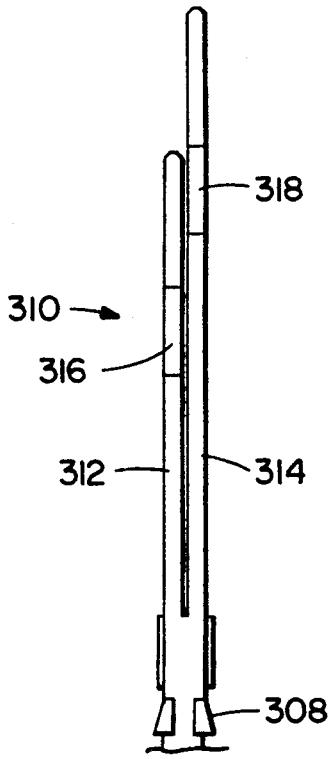
FIG. 7B is a plan front view of a contact used in the connector shown in FIG. 7A.
Figure 7A:
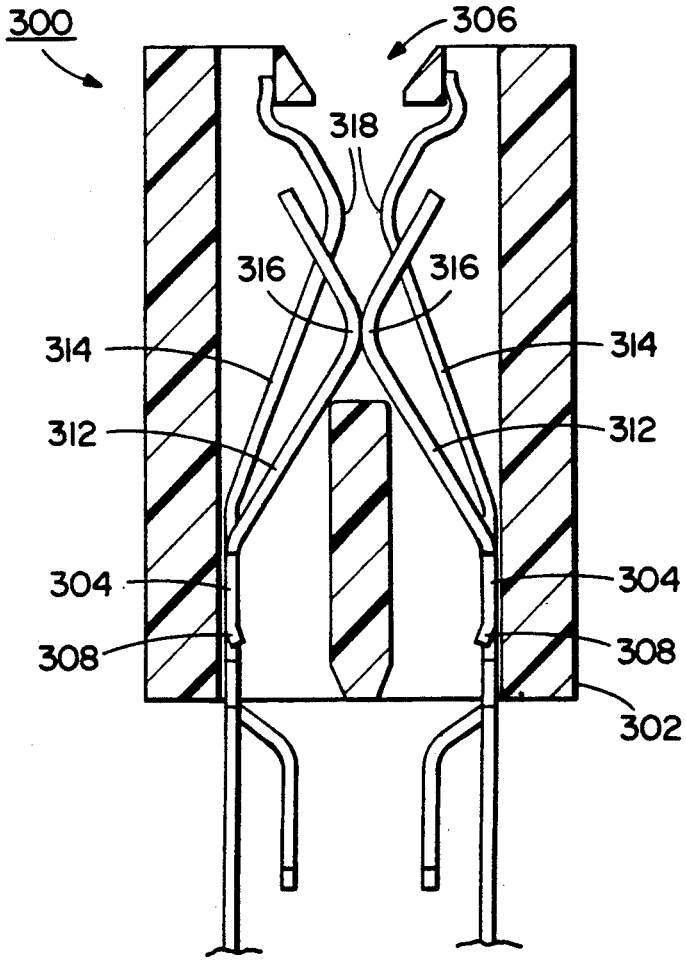
FIG. 7A is a cross-sectional view of another alternate embodiment of a connector incorporating features of the present invention.

Referring now to FIGS. 7A and 7B, an alternate embodiment of the invention is shown. In the embodiment shown, the connector 300 has a housing 302 with two rows of contacts 304 on opposite sides of edge receiving slot 306. As can be seen in FIG. 7B, each contact has a middle section 308 fixed to the housing 302 and a bifurcated or forked top section 310. The top section 310, in the embodiment shown, has a first cantilever arm 312 and a second cantilever arm 314. The first arm 312 has a lower contact surface 316. The second arm 314 has an upper contact surface 318. The contacts 304 are comprised of electrically conductive material such that the arms 312 and 314 of each contact are electrically connected to each other. The opposing contacts 304 in each row have portions of their top sections 310 located in the slot 306 in a home position. In the embodiment shown, the lower contact surfaces 316 of the opposing contacts 304 contact each other in the home position to form an electrical bridge between the contacts.

In a preferred embodiment, the pair of opposing contacts includes one signal contact and one ground contact. As a daughter board is inserted into the slot 306, the opposing contacts are pushed apart to separate the signal contact from the ground contact. This type of embodiment may be particularly useful with a multipurpose card edge connector adapted to be used with different types of cards insertable into the housing 302 at different depths of insertion.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A card edge connector comprising:

a housing comprised of electrically insulating material and having a card edge receiving slot and at least one row of contact chambers partially open to said slot;

a plurality of spring contacts at least partially movably positioned in said contact chambers; and means for selectively electrically connecting at least two of said contacts to each other, said means for connecting comprising said at least two contacts being located adjacent each other in said at least one row of contact chambers and being movable into and out of contact with each other.

2. A connector as in claim 1 wherein said contacts comprise a first type of contact extending from a first section connected to said housing towards said slot at a first angle in a home position and, a second type of contact extending from a second section connected to said housing towards said slot at a second different angle in a home position.

3. A connector as in claim 1 wherein said housing comprises two rows of contact chambers on opposite sides of said slot with at least some opposing contacts in said rows being adapted to contact each other in a home position.

4. A connector as in claim 1 wherein said contacts include a first type of contact with a transverse extending bridge section adapted to contact an adjacent second type of contact.

5. A connector as in claim 4 wherein said bridge section is located at a top of said first type of contact.

6. A connector as in claim 5 wherein said housing contact chambers include a pair of adjacent contact chambers with interconnected open tops.

7. A connector as in claim 6 wherein said second type of contact is prestressed at its top against a portion of said housing in a home position with said top of first type of contact thereagainst.

8. A card edge connector comprising:

a housing comprised of dielectric material and having a card edge receiving slot and a row of contact chambers communicating with said slot; and at least one pair of switching contacts movably mounted in said chambers, said contacts having a first position wherein said contacts are electrically connected to each other and a second position wherein said contacts are spaced from each other with one contact of said pair intended to be a grounding contact and the other contact of said pair intended to be a signal contact when a daughter board is inserted into the slot.

9. A connector as in claim 8 wherein said pair of switching contacts include a first type of contact and an adjacent second type of contact.

10. A connector as in claim 8 wherein said housing has two rows of contact chambers on opposite sides of said slot and said pair of contacts include a contact in each row that contact each other in their first position.

11. A connector as in claim 8 wherein said pair of contacts each have a daughter board contact area located at a different level in said slot.

12. A method of connecting a daughter board to a card edge connector, the method comprising steps of:

inserting an edge of the daughter board into a card edge receiving slot of the connector; and converting grounded signal contacts into non-grounded signal contacts upon insertion of the daughter board into the slot, the step of converting comprising the daughter board pushing on ground contacts and the grounded signal contacts as the daughter board is inserted into the slot to separate the ground contacts and signal contacts from each other wherein the step of converting comprises displacing bridging contact areas of said signal contacts and said ground contact different distances as the daughter board is inserted.

13. A method as in claim 12 wherein the step of converting comprises the daughter board displacing contact areas of the contacts a first distance from a home position and briding contacts areas of the contacts a second different distance from a home position.

14. A card edge connector comprising:

a housing compared of electrically insulating material and having a card edge receiving area and at least one row of contact chambers;

a first type of contact located in said contact chambers with a first daughter board contact area located at a first level in said card edge receiving area; and a second type of contact located in said contact chambers with a second daughter board contact area located at a second level in said card edge receiving area, said second type of contact electrically contacting said first type of contact in a first position and being movable, by insertion of a daughter board into said receiving area, to a second position wherein said first and second types of contacts do not electrically contact each other.

15. A card edge connector comprising:

a housing comprised of dielectric material and having a card edge receiving area and two opposing rows of contact chambers; and spring contacts connected to the housing with portions located in the opposing rows of contact chambers and the receiving area, each contact being comprised of a single electrically conductive member and having a first section fixedly connected to the housing and a second cantilever section, the cantilever section having two arms extending separately from the first section, each arm having a contact surface located at different distances from the first section such that the two arms are electrically connected to each other, but are contacted at different depths of insertion of a card into the receiving area.

16. A connector as in claim 15 further comprising means for selectively electrically disconnecting contacts in opposing rows from each other as card is inserted into the receiving area.

* * * * *